United States Patent [19]

Venable

[11] Patent Number: 5,052,727

[45] Date of Patent: Oct. 1, 1991

[54] CUSHIONED LATCH

[75] Inventor: Phillip G. Venable, Joliet, Ill.

[73] Assignee: Case Corporation, Racine, Wis.

[21] Appl. No.: 539,419

[22] Filed: Jun. 15, 1990

[51] Int. Cl.[5] ..... E05C 3/14

[52] U.S. Cl. ..... 292/19; 292/DIG. 47; 292/202

[58] Field of Search ..... 292/339, 202, 230, 238, 292/246, 218, 219, DIG. 30, DIG. 47, DIG. 31, 19

[56] References Cited

U.S. PATENT DOCUMENTS

| | | | |
|---|---|---|---|
| 548,218 | 10/1895 | Oliver | 292/202 X |
| 1,925,234 | 9/1933 | Dath | 292/218 |
| 2,079,283 | 5/1937 | Etling | 292/202 X |
| 2,565,752 | 8/1951 | Bjelland | 292/62 |
| 3,158,908 | 12/1964 | Springer | 292/DIG. 30 X |

*Primary Examiner*—Richard E. Moore
*Attorney, Agent, or Firm*—Dykema Gossett

[57] ABSTRACT

A window latch mechanism for use on cab structures associated with agricultural and construction machinery having improved resistance against breakage. The resistance against breakage is accomplished by constructing the window latch from a resilient material shaped in a forked configuration having a first and second tine. The latches are oriented such that the tines maintain a general vertical orientation. The window latch is pivotally connected to one tine, and the remaining tine is supported by the window slide. Vertical forces imparted to the window are reflected onto the latch and cause the resilient latch tines to move relative to each other, thereby allowing the tines to absorb the forces. The window latch is associated with a window slide having one longitudinal surface which cooperates with the sides of the window to permit vertical location of the window, and another longitudinal side of the slide includes a plurality of notches whereby the latch mechanism can be engaged in the notched to permit placement of the window in any number of vertical positions.

10 Claims, 2 Drawing Sheets

CUSHIONED LATCH

TECHNICAL FIELD

The present invention relates to window mechanisms and deals more specifically with window latch mechanisms used on agricultural and construction machinery which permit window movement while being highly resistant against breakage.

BACKGROUND OF THE INVENTION

Cab structures associated with agricultural and construction machinery commonly employ one or more windows. These cab structures typically form the environment in which a person is situated during the operation of the vehicle. Many of the window systems used on cabs associated with agricultural and construction machinery employ latch mechanisms for opening and securing the windows, whereby the operator can directly access the outside environment. This is often necessary for controlling the temperature of the cab; however, even if the environment of the cab is internally controlled, it is often necessary for the cab operator to converse with other workers or to improve the operator's visibility.

Although window latching mechanisms are known to those skilled in the art for cooperating with and to provide a system for covering, partially covering or exposing an opening in a vehicle cab, these latch mechanisms have not been able to withstand the vibrational and jarring forces imparted to the latch (through its associated window) during the normal operation of the associated vehicle. This failure of latch mechanisms is due in part to the large force exerted on the latches by the customarily large, heavy windows associated with agricultural and construction machinery.

Accordingly, it is an object of this invention to increase the useful life of latch mechanisms used on windows associated with agricultural and construction machinery.

It is a feature of this invention to have a latch mechanism employing a shock-absorbing forked lever having one tine associated with the window and another tine associated with a window slide. The tines of the fork are flexible, thereby absorbing vibrational energy imparted to the latch during operation of the vehicle.

It is an advantage of this invention that when the latch mechanism experiences vibrational forces, the latch will break far less readily than prior art designs because of its ability to flex.

SUMMARY OF THE INVENTION

Accordingly, the present invention provides a window latch for use with a vehicle cab structure associated with agricultural and construction machinery. The latch is used to support a cab window at a desired position within an opening of the cab. The cab opening employs slide members along opposite sides of the opening for guiding the movement of the window. Each slide member is associated with one side of the window and adapted to permit the window to slide along the slide members. The latch includes a base member which is attached proximal the side of the window, a shock-absorbing forked lever which has two flexible tines is pivotally mounted by way of one its tines to the base member, and the remaining tine is retainingly engaged to the slide which is proximal the base member. When, under normal operation of the vehicle, the vibrational forces are imparted to the window, these forces are transmitted to one tine of the lever. The other tine remains fixed to the slide, thereby causing the tines to flex, in vertical relation to each other. This relative flexing of the tines causes them to perform as a spring, thereby absorbing the vibrational energy imparted to the window.

In a preferred embodiment, the window slides include a plurality of spaced notches and a plurality of elongated grooves. the spaced notches provide a means or receiving one of the tines of the fork for holding the window in a selected position. The fork is preferably biased such that an upward force of sufficient urging will cause the fork to ratchet along the slide notches until the desired window position is achieved. To downwardly adjust the window, the latch mechanism must be disengaged from the notches before downward movement can be achieved.

DETAILED DESCRIPTION OF THE PREFERRED EMBODIMENTS

Figure 1:
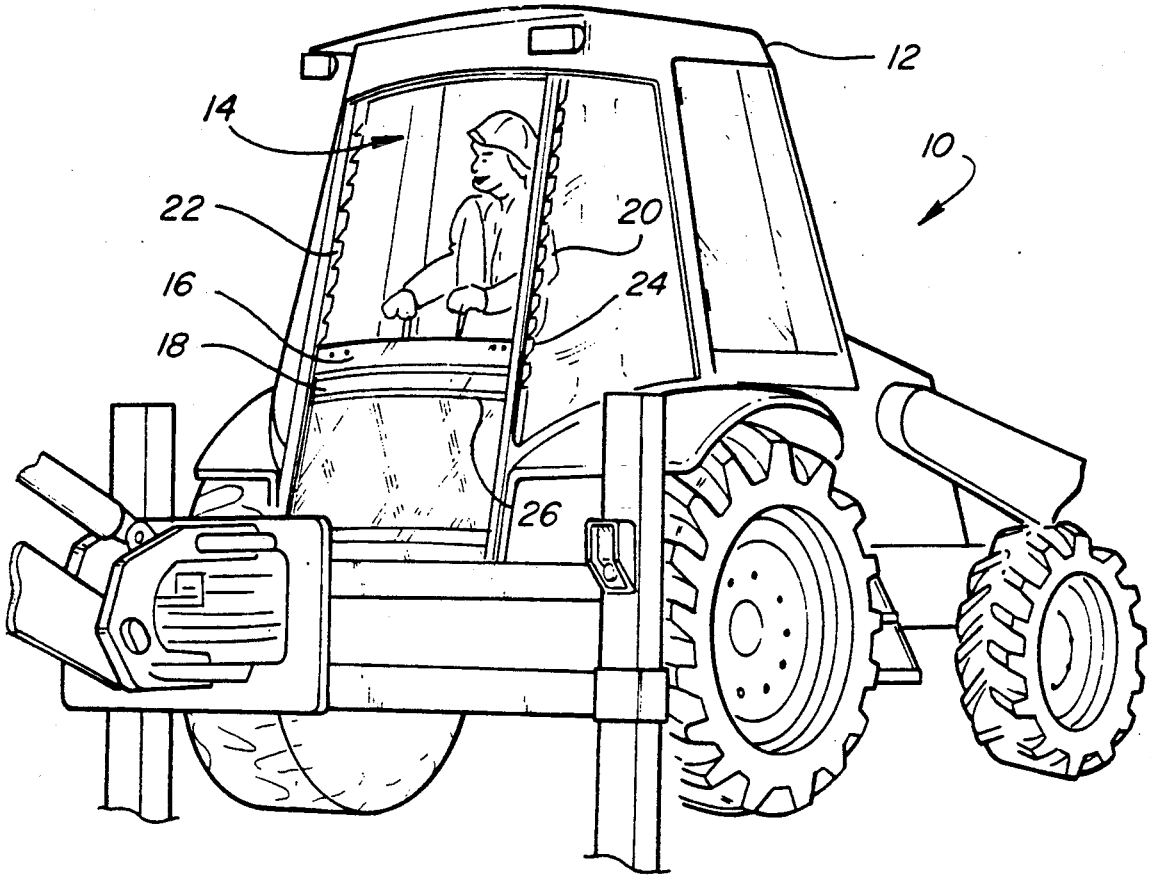
FIG. 1 is a partial view of a typical construction machine showing the typical placement of the windows of the cab structure when they are engaged in the open position.

Now referring to the drawing of FIG. 1, back hoe 10 is shown having a cab 12 and window opening 14. Windows 16, 18 are shown in their lowermost position, thereby exposing operator 20 to the environment outside of cab 12. Windows 16, 18 are adapted to freely move within opening 14 along window slides 22, 24. Bottom window 26 does not move within slides 22, 24 but remains stationary in the bottom-most portion of opening 14.

Figure 2:
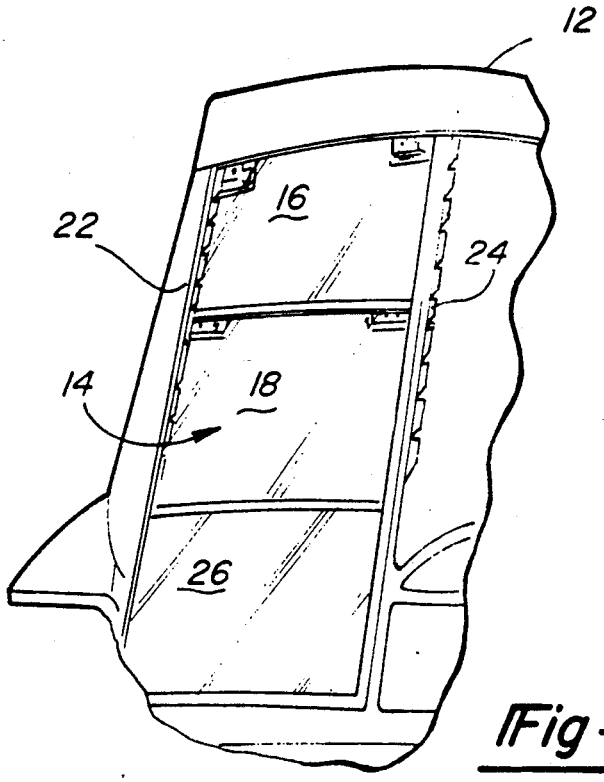
FIG. 2 is a partial view of the cab structure of FIG. 1 showing the windows in their closed position.

Now referring to the drawing of FIG. 2, opening 14 of cab 12 is shown with windows 16, 18 in their raised position, thereby complete sealing opening 14 from the environment outside of cab 12. It is important to note that operator 20 (not shown) can operate backhoe 10 with windows 16, 18 in their raised position or their lowered position (as shown in FIG. 1) or in any position therebetween. As will be discussed in more detail, windows 16, 18 and 26 and slides 22, 24 are adapted to completely seal off cab 12 from the outside environment. This not only provides operator 20 with protection from the outside environment, but provides a means for protecting electronics and sensitive instrumentation and securing valuables located within cab 12.

Figure 3:
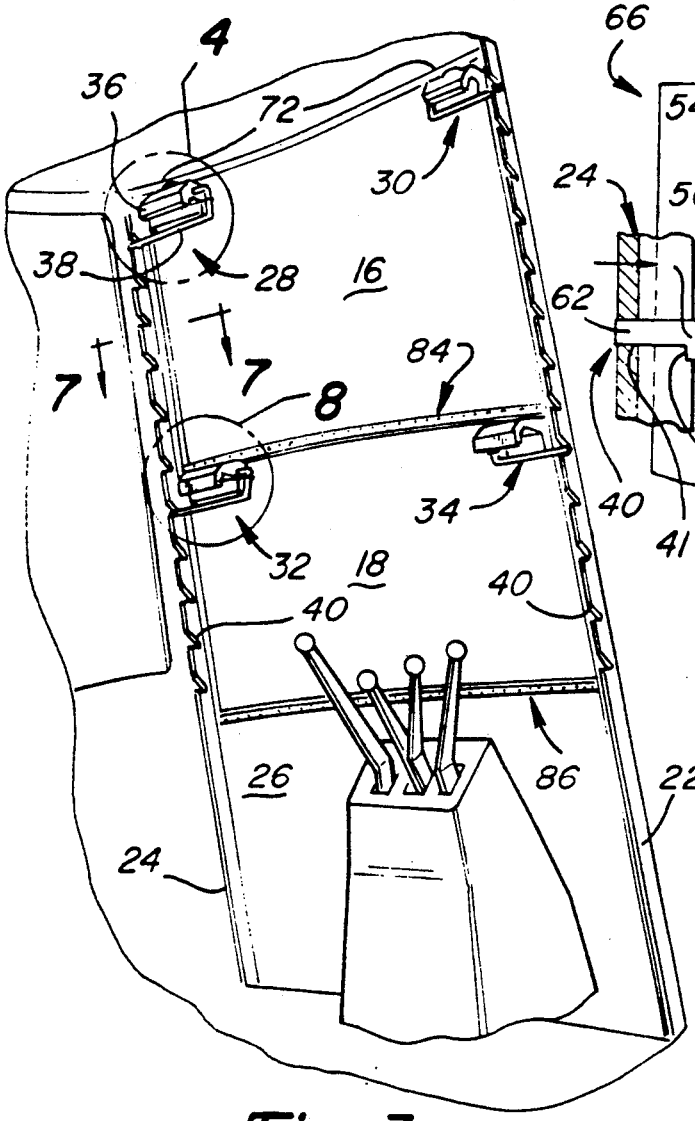
FIG. 3 is a partial view of the cab structure of FIG. 1 showing the window latch mechanism as it would be seen from the inside of the cab.

Now referring to the drawing of FIG. 3, windows 16, 18 are each provided with a respective pair of latch mechanisms 28, 30 and 32, 34. Each latch mechanism 28–34 is mounted to a respective side of its associated window in close proximity to its associated slide 22, 24.

Each latch mechanism consists of base member 36 and shock-absorbing C-shaped forked lever 38. Slides 22, 24 each have a plurality of notched portions 40 running along the length of one of their longitudinal sides. One end of forked lever 38 is designed to be received within a notch 40, thereby preventing its associated window from sliding downwardly within window slides 22, 24.

Figure 4:
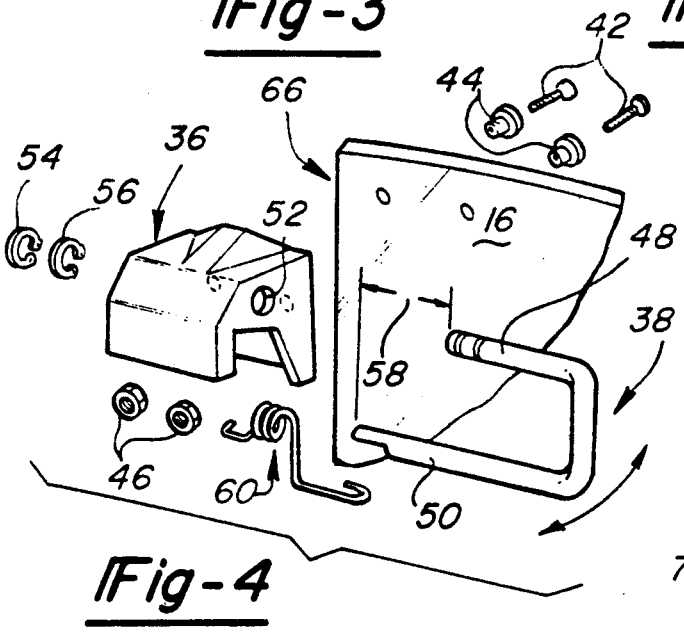
FIG. 4 is an exploded view of the latch mechanism of the present invention as referenced by numeral 4 in FIG. 3.

Now referring to the drawing of FIG. 4, base member 36 is adapted to be fastened to window 16 via bolts 42, grommets 44 and nuts 46. Shock-absorbing C-shaped fork lever 38 is comprised of a first tine 48 and second tine 50. First tine 48 is received within bore 52 of base member 36 and is retained within base member 36 by virtue of retaining clips 54, 56. Bore 52 is appropriately sized so that it provides a slip fit for first tine 48, whereby first tine 48 is allowed to pivot within bore 52. Second tine 50 is longer than first tine 48, as shown by reference numeral 58. By making second tine 50 longer, it is adapted to extend beyond base 36 and engage notch 40 of slide 24 as has heretofore been explained. Spring (or biasing means) 60 is adapted to cooperate with base member 36 and fork lever 38 in a way which forces second tine 50 of lever 38 into notch portion 40 of slide 22. By biasing second tine 50 inwardly, second tine 50 is prevented from accidentally disengaging from notch 40. This prohibits windows 16, 18 from inadvertently sliding downwardly within their respective tracks formed within slide members 22, 24. Spring 60 also biases fork lever 38 such that first and second tines 48, 50 assume a generally vertically alignment. When tines 48, 50 assume a vertical alignment, lever 38 effectively forms a resilient spring which absorbs any vertical shock or vibration seen between base 36 and the slide notch which supports second tine 50. In its most preferred embodiment, fork lever 38 is formed from stainless steel, spring steel or the like and has a diameter which is appropriately sized to provide sufficient dampening from the vehicle operating environment and glass size associated therewith.

Figure 5:
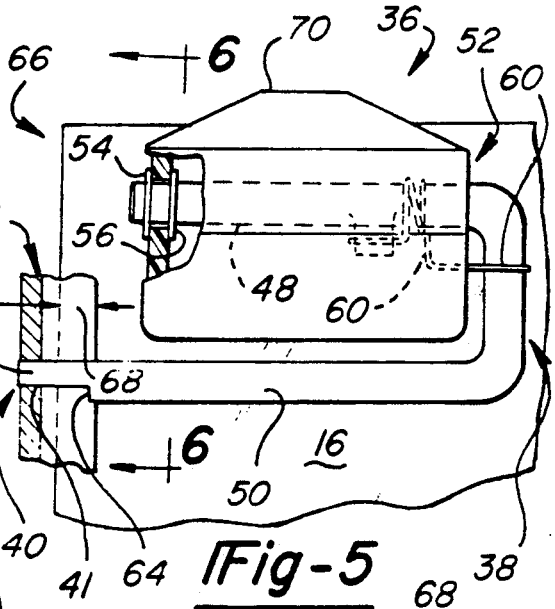
FIG. 5 is the latch mechanism of the present invention shown in its operational environment.

Now referring to the drawing of FIG. 5, base member 36 is fastened to window 16 via bolt 42, grommet 44 and nut 46 (bolt, grommet and nut shown in FIG. 4). First tine 48 of shock-absorbing forked lever 38 traverses bore 52 and is retained therein by retaining clips 54, 56. Second tine 50, at its outermost end 62, engages notch 40. This engagement prevents window 16 from sliding downwardly. End 62 of second tine 50 is notched at 64 to provide sufficient engagement surface area against slide 24 so as to not overload the load-bearing surface 41 of notch 40. This is an important feature of the present invention inasmuch as slides 22, 24 are preferably comprised of high-density plastic.

Left side 66 of window 16 is received into a track 68 of window slide 24. Not only does track 68 provide a convenient means for maneuvering window 16 in and out of position, but also provides a weather-tight seal between track 24 and window 16. The right-hand side of window 16 is received within a respective track on window slide 22. This track on slide 22 is substantially parallel to the track on window slide 24 which receives the left-hand side 66 of window 16. This substantially parallel arrangement of tracks allows for window 16 to slide vertically within opening 14 of cab 12. Each pair of notches 40 are substantially horizontally arranged whereby windows 16 and 18 can be adjusted to any one of various notched positions along slides 22, 24. The right and left latch 30, 28 and slide arrangement 22, 24, which has heretofore been explained for window 16, is substantially identical to that for window 18 and need not be duplicated. The only difference between the latch arrangements for upper window 16 (latch arrangements 28, 30) and the latch arrangements for the lower window 18 (latch arrangements 32, 34) is the presence of bumper portion 70 on upper latch pair 28, 30. Bumper portion 70 provides a contact means between base members 28, 30 and electrical switches (not shown) used to disable the cab's windshield wipers (not shown) when window 16 is not fully raised.

Figure 6:
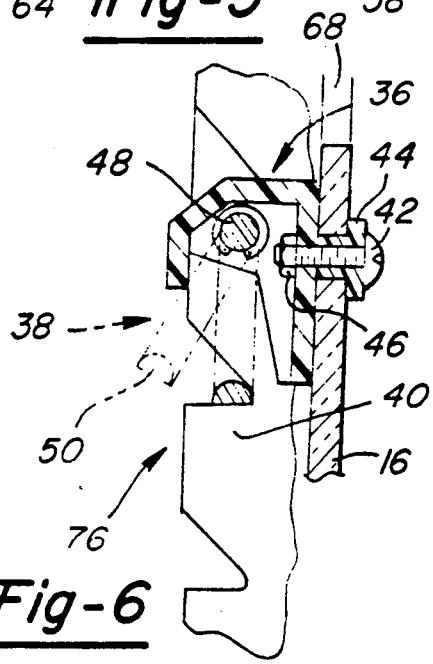
FIG. 6 is a latch mechanism of the present invention taken substantially along line 6—6 of FIG. 5.

Now referring to the drawing of FIG. 6, first tine 48 of shock-absorbing fork lever 38 is pivotally attached to base member 36 as previously described. When it is desired that the windows be lowered, the operator must grab the appropriate window's opposing latches and pull second tine 50 of each latch outwardly while lifting slightly on the base. The slight upward lifting force applied to the base allows second tine 50 to clear load-bearing surface 41 of notch 40 and the outward urging of second tine 50 allows it to clear the notch opening once sufficient upward motion is achieved. Once second tines 50 of the latches have cleared their respective notch openings, the windows may be freely lowered to any one of the notched positions available in first and second window slide 22, 24. Spring 60 ensures that second tine 50 is inwardly biased into notch 40 so that only an outward biasing force of sufficient urging will cause second tine 50 to disengage from notch 40.

When it is desired to move a window higher, the windows are designed so that an upward force placed on a window's latches will cause the second tines 50 of the respective latches to disengage from their respective notch and "ratchet" along the engaging surface 76 of slides 22, 24 until the next higher notch is encountered, wherein the inward urging of spring 60 will cause second tine 50 of each latch to engage the notch. Thus, it can be seen that in order to raise the windows, a simple upward urging on a selected pair of latches is all that is necessary. This upward urging will cause the second tines of the latches to "skip" along engaging surface 76 of window slides 22, 24 until the window is lowered by the operator. Upon lowering the window, the second tines will engage in the first set of notches they encounter.

Figure 7:
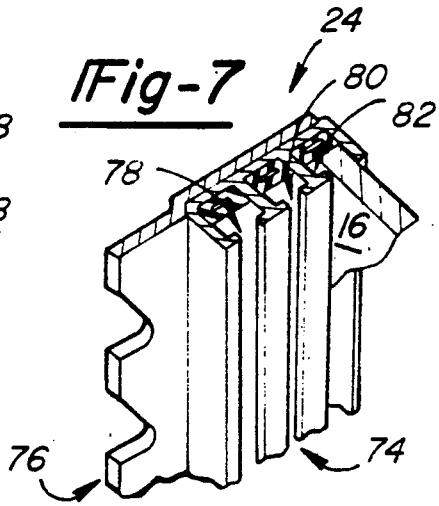
FIG. 7 is the elongated window slide of the present invention taken substantially along line 7—7 of FIG. 3.

Now referring to the drawing of FIG. 7, window slide 24 has a first longitudinal (or track) surface 74 and a second longitudinal (or engaging) surface 76. Longitudinal surface 74 has a plurality of tracks 78-82. Each track is associated with one side of the windows 16, 18 and 26. In the preferred embodiment of the present invention, window 16 resides in track 82, window 18 resides in the middle track 80, and lower window 26 resides in track 78. This arrangement provides the proper overlap which permits rain to travel down windows 16, 18 and 26 in a way which minimizes the possibility that rain may find its way into cab 12 between window seams 84, 86 (see FIG. 3). In its most preferred embodiment, window slide 24 is comprised of a high-impact plastic.

Figure 8:
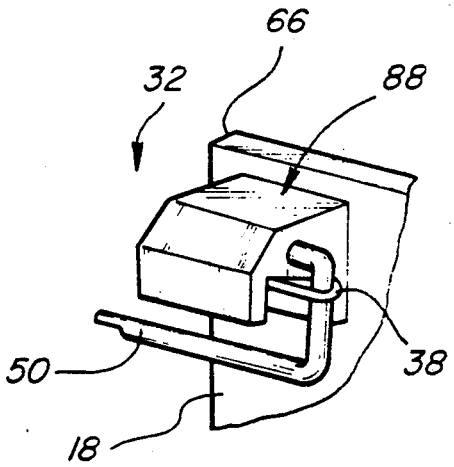
FIG. 8 is a second embodiment of the latch mechanism of the present invention as referenced by numeral 8 in FIG. 3.

Now referring to the drawing of FIG. 8, latch mechanism 32 is exemplary of the latch mechanisms associated with middle window 18. The latch mechanisms associated with middle window 18 are identical to the latch mechanisms associated with upper window 16 (latch mechanisms 28, 30), except for the absence of bumper portion 70. Latch mechanism 32, in place of bumper 70, merely has a flat planar upper portion 88. There is no need to construct bumper 70 on the latch mechanisms 32, 34 associated with middle window 18 because, unlike window latch mechanisms 28, 30, they are not used to engage an electrical switch.

The foregoing detailed description shows that the preferred embodiments of the present invention are well suited to fulfill the objects of the invention. It is recognized that those skilled in the art may make various modifications or additions to the preferred embodiments chosen here to the illustrate the present invention, without departing from the spirit of the present invention. Accordingly, it is to be understood that the sought to be afforded hereby should be deemed to extend to the subject matter defined in the appended claims, including all fair equivalents thereof.

What is claimed is:

1. For use with a vehicle cab structure associated with agricultural and construction machinery, a window latch for supporting a window of said cab at a desired position within an opening of said cab, said cab opening having slide members disposed along opposite sides of said opening, each said slide member respectively associated with one side of said window and adapted to permit said window to slide along said slide members, said latch comprising:

a base member attached to said window proximal to one side, a generally C-shaped shock-absorbing forked lever, said lever having first and second resilient tines, said first tine pivotally mounted to said base member and said second tine generally vertically aligned with said first tine and retainingly engaged by said slide proximal said base member, whereby when under normal operation of said vehicle, vibrational forces are imparted to said window, said first and second associated tines flex in vertical relation to one another, thereby absorbing the vibrational energy imparted to said window.

2. The latch of claim 1 further including biasing means connected to said lever for urging said second tine against said proximal slide whereby said second tine is retained by said proximal slide in general vertical alignment with said first tine.

3. The latch of claim 2 wherein said second tine is longer than said first tine and wherein the end of said second tine is retainingly engaged by said proximal slide.

4. The latch of claim 1 further including a second base member attached proximal to the side of said window opposite said first base member, a second shock-absorbing forked lever, said second lever having a first and second flexible tine, said first tine of said second lever pivotally mounted to said second block and said second tine of said second lever generally vertically aligned with said first tine of said second lever and retainingly engaged by said slide proximal said second base member, whereby said vertical loading imparted to said window is distributed to both said first and second forked levers, causing said tines of each lever to flex in vertical relation to one another, thereby absorbing the vibrational energy imparted to said window.

5. The latch of claim 4 further including a first and second biasing means, each biasing means respectively associated with a forked lever for urging the second tine of its respective lever against each lever's proximal slide whereby said second tine of each fork is retained by its proximal slide generally in vertical alignment with the first tine of its associated fork.

6. For use on a vehicle cab structure associated with agricultural and construction machinery, a window apparatus comprising:

at least one window having two substantially parallel opposing sides, a pair of elongated window slides fastened to opposing vertical sides of an opening of said vehicle cab, each of said slides having a first and second longitudinal surface, said first surface of each slide adapted to cooperate with a respectively associated side of said window to permit vertical movement of said window along said first surface of said slides, a pair of latches, each having a base and a shock-absorbing fork, each latch respectively associated with one of said slides and each base attached to said window proximate its respective slide, each shock-absorbing fork having associated first and second flexible tines, said first tine of each fork pivotally received within its respective base and said second tine of each fork retainingly received by said second surface of its respective slide, said second tine of each fork generally vertically aligned with its associated first tine, whereby when under normal operation of said vehicle, said vehicle imparts vertical vibrational loading to said window, said tines of said forks resiliently flex in vertical relation to their associated tines, thereby absorbing the vibrational energy imparted to said fork.

7. The apparatus of claim 6 wherein said second tine of each fork is longer than its associated first tine, and wherein said second longitudinal surface of each slide includes a plurality of spaced notches adapted to receive the second tine of its respective latch.

8. The apparatus of claim 7 wherein each said latch includes biasing means for biasing said latch's absorbing fork such that said fork's second tine is urged into retaining engagement with one of said notches in said second surface of said respective slide.

9. The apparatus of claim 8 wherein said slide notches are downwardly canted, whereby an upward urging of sufficient force upon said window or said latches of said window will cause said second tine of each fork to disengage with a presently retaining first notch, and re-engage with a second notch disposed above said first notch.

10. The apparatus of claim 6 wherein said first surface of each of said slides includes vertically elongated grooves adapted for slidingly engaging a respective side of said window, thereby forming a vertical track for said window to slide within.

* * * * *